US009010432B2

(12) United States Patent
Edwards

(10) Patent No.: US 9,010,432 B2
(45) Date of Patent: Apr. 21, 2015

(54) SUBSEA APPARATUS

(75) Inventor: Jeffrey Charles Edwards, Aberdeen (GB)

(73) Assignee: Enovate Systems Limited, Dyce, Aberdeen, Aberdeenshire (GB)

( * ) Notice: Subject to any disclaimer, the term of this patent is extended or adjusted under 35 U.S.C. 154(b) by 1071 days.

(21) Appl. No.: 13/119,126

(22) PCT Filed: Sep. 16, 2009

(86) PCT No.: PCT/GB2009/002237

§ 371 (c)(1),
(2), (4) Date: Aug. 3, 2011

(87) PCT Pub. No.: WO2010/032019

PCT Pub. Date: Mar. 25, 2010

(65) Prior Publication Data

US 2011/0315392 A1 Dec. 29, 2011

(30) Foreign Application Priority Data

Sep. 16, 2008 (GB) ..... 0816898.1

(51) Int. Cl.

| | |
|---|---|
| ***E21B 33/035*** | (2006.01) |
| ***E21B 23/04*** | (2006.01) |
| ***E21B 33/043*** | (2006.01) |
| ***E21B 33/068*** | (2006.01) |
| ***E21B 34/04*** | (2006.01) |

(52) U.S. Cl.

CPC ..... *E21B 33/035* (2013.01); *E21B 23/04* (2013.01); *E21B 33/0355* (2013.01); *E21B 33/043* (2013.01); *E21B 33/068* (2013.01); *E21B 34/04* (2013.01)

(58) Field of Classification Search

CPC ... E21B 23/04; E21B 33/035; E21B 33/0355; E21B 33/043; E21B 33/068; E21B 34/04; E21B 41/04

USPC ..... 166/338–340, 351, 365, 368, 386, 85.3; 254/340, 360–362

See application file for complete search history.

(56) References Cited

U.S. PATENT DOCUMENTS

| | | | | | |
|---|---|---|---|---|---|
| 4,730,677 | A | * | 3/1988 | Pearce et al. | 166/345 |
| 5,029,642 | A | * | 7/1991 | Crawford | 166/72 |
| 5,180,012 | A | * | 1/1993 | Crawford | 166/301 |
| 5,782,297 | A | * | 7/1998 | Samuels et al. | 166/85.1 |
| 5,988,277 | A | * | 11/1999 | Vick et al. | 166/123 |
| 6,012,528 | A | * | 1/2000 | Van Winkle | 166/339 |
| 6,062,312 | A | * | 5/2000 | Wilkins | 166/340 |
| 6,926,467 | B1 | * | 8/2005 | Andersen et al. | 405/191 |
| 7,063,157 | B2 | * | 6/2006 | Bartlett | 166/339 |
| 7,241,077 | B2 | * | 7/2007 | Webster et al. | 405/195.1 |
| 8,006,765 | B2 | * | 8/2011 | Richards et al. | 166/351 |

(Continued)

FOREIGN PATENT DOCUMENTS

| | | |
|---|---|---|
| WO | WO-97/11253 A1 | 3/1997 |
| WO | WO-00/01922 A1 | 1/2000 |

*Primary Examiner* — Matthew Buck

(74) *Attorney, Agent, or Firm* — Tarolli, Sundheim, Covell & Tummino LLP

(57) ABSTRACT

An apparatus (10) for remotely running a subsea production tree (12) and desuspending a well is described. The apparatus comprises a tree running tool (16) adapted to be connected to a production tree, at least one downhole tool, at least one of the tools being a plug retrieval tool (22) and a tool deployment device (18) in hydraulic communication with at least the plug retrieval tool to hydraulically operate the plug retrieval tool.

43 Claims, 10 Drawing Sheets

(56) References Cited

U.S. PATENT DOCUMENTS

| | | | | |
|---|---|---|---|---|
| 8,028,752 | B2 * | 10/2011 | Richards | 166/339 |
| 8,235,124 | B2 * | 8/2012 | Cuiper et al. | 166/365 |
| 8,672,037 | B2 * | 3/2014 | Schuurman et al. | 166/340 |
| 2002/0011336 | A1 | 1/2002 | Baskett et al. | |
| 2004/0163818 | A1 * | 8/2004 | Fenton et al. | 166/368 |
| 2005/0217844 | A1 * | 10/2005 | Edwards et al. | 166/85.1 |
| 2009/0159273 | A1 * | 6/2009 | Guerrero | 166/250.01 |
| 2009/0236100 | A1 * | 9/2009 | Lawson | 166/339 |
| 2010/0294479 | A1 * | 11/2010 | Shee | 166/65.1 |
| 2011/0094749 | A1 * | 4/2011 | Richards et al. | 166/345 |

* cited by examiner

SUBSEA APPARATUS

FIELD OF THE INVENTION

The present invention relates to an apparatus and method for running a subsea production tree and de-suspending a well.

BACKGROUND TO THE INVENTION

As existing oil fields in shallow water environments become depleted, exploration and oil field development in deep water areas is becoming more common. However, these deep water areas provide challenges and the operating costs and time to perform operations are far greater than in the traditional shallow water environments. One example of this is the deployment and installation of subsea production trees. In relatively shallow environments a tree can be installed relatively quickly, however, in deep water environments, for example 1500 meters, operational time is greatly increased. As drilling rigs which are capable of operating at this depth cost in the order of $750,000 per day it is desirable to minimise the time for which the rig is required.

Traditionally, completion and tree deployment have been conducted as a single phase operation, however, this leads to the drilling schedule being dependent upon the tree delivery schedule. In order to mitigate this dependence between tree delivery and drilling programme, "batch" drilling and completion operations are undertaken followed by a programme of "batch" tree deployment and well clean up operations. Once the drilling and completion operations are finished the well is suspended by a plug which seals the well bore. When the tree deployment and well clean up operations take place the tree is installed and integrity tested, and the plug is removed.

Batch operating, however, can lead to a considerable period of time elapsing between well completions and clean up operations. Although this increases the efficiency of rig operations, it can have a detrimental effect on well productivity.

SUMMARY OF THE INVENTION

According to a first aspect of the present invention there is provided an apparatus for remotely running a subsea production tree and de-suspending a well, the apparatus comprising:

a tree running tool adapted to be connected to a production tree;

at least one downhole tool, at least one of the tools being a plug retrieval tool; and a tool deployment device in hydraulic communication with at least the plug retrieval tool to hydraulically operate the plug retrieval tool.

In one embodiment, an apparatus is provided which can be used to run a production tree down to a well-head and de-suspend the well by removal of the downhole plug by a tool. Using a self-contained apparatus to perform these functions allows the operations to be performed relatively quickly without the need for the installation of a riser.

Preferably, the apparatus is adapted to be lowered from a ship or other mono-hull vessel. As the apparatus is a self-contained unit, it can be run from a conventional ship or vessel and does not require the provision of a rig or other highly expensive deployment vehicle.

Preferably, the apparatus further comprises a control interface.

Preferably, the control interface is adapted to interact with at least one control device.

Preferably, the control device is a remotely operated vehicle (ROV). The function of an ROV interface is to provide a platform to position an ROV and enable the ROV to interact with the plug retrieval tool and tool deployment device. Using a remotely operated vehicle to control the apparatus reduces the need for electric cables or hydraulic lines to be run from the surface to the seabed.

Alternatively, the control device is operated from surface.

Preferably, the tool deployment device is hydraulically operated.

Alternatively or additionally, the control device is electrically, pneumatically or hydraulically/electrically operated or by any suitable means.

Preferably, the tool deployment device comprises at least one winch.

Preferably, the/each winch is hydraulically operated.

Alternatively or additionally, the winch is electrically, pneumatically or hydraulically/electrically operated or by any suitable means.

Preferably, the/each winch comprises a winch drum.

Preferably, the/each winch drum is driven by at least one hydraulically operated motor.

Preferably, the/each winch drum is driven by at least one hydraulically operated piston motor.

In one embodiment there are first and second winches, each winch being driven by a hydraulically operated piston motor.

In this embodiment each winch is adapted to raise or lower a hydraulically operated tool into a well bore.

At least one of the tools may be a plug running tool.

Preferably, the hydraulically operated deployment device is adapted to be operated by the hydraulic output of an ROV.

In one embodiment, one of said winches is adapted to raise or lower the plug retrieval tool out of or into the well.

Preferably, the tool deployment device further comprises at least one flexible tension member to raise or lower the at least one tool.

The flexible tension member may be a hose. The plug retrieval tool can be raised and lowered using the hose. Flexibility permits the hose to be deployed using the winch and stored on the winch drum, thereby saving space.

Preferably the hose is a hydraulic hose. A hydraulic hose can be used to provide hydraulic fluid to the plug retrieval tool.

Preferably, the hose comprises multiple layers or spirals.

In one embodiment the hose is a six spiral wire reinforced hose.

Preferably, the hose has a nylon core tube. A nylon core tube has excellent chemical resistance.

Preferably the hose has a polyurethane cover. A polyurethane cover is extremely tough and abrasion resistant.

In one embodiment the hose has a collapse pressure of 9,760 psi and a maximum internal pressure of 26,100 psi.

Alternatively, the hose may be a steel line or any suitable pressure conduit.

Alternatively, the flexible tension member may be a cable, particularly a wireline cable. Preferably the apparatus comprises at least one attachment device adapted to allow at least one line or rope to be attached to the apparatus to facilitate raising and lowering of the apparatus from a vessel to the seabed.

Preferably, the apparatus further comprises a storage portion.

Preferably, the storage portion is a high pressure portion.

Preferably, the storage portion is adapted to house the/each tool and, in use, a downhole plug.

Preferably, the tree running tool permits, in use, the self-contained apparatus to communicate with the production tree.

Preferably, the tree running tool permits the apparatus to communicate hydraulically with the production tree. Such an arrangement provides a hydraulic communication path from an ROV via the apparatus, to the tree control system to enable the tree to be latched and subsequently pressure and function tested.

Preferably, the apparatus comprises a tool catcher. The tool catcher provides protection for inadvertent loss of the plug retrieval tool and/or, in use, a downhole plug.

Preferably, the tool catcher is located at or adjacent to a lower end of the conduit.

Preferably, the plug-retrieving tool is hydraulically actuated.

Preferably, in use, the plug-retrieving tool is adapted to apply an upward force to a plug to release the plug from a conduit.

Preferably, the/each tool is hydraulically actuated.

According to a second aspect of the present invention there is provided an apparatus for performing a downhole operation comprising:

a housing adapted to be connected a subsea production tree;

at least one hydraulically operated tool for performing a downhole operation;

at least one flexible hydraulic hose, a hose being attached to the/each tool; and at least one winch.

In at least one embodiment of the invention, a self contained apparatus is provided which permits a tool to be run to a downhole location and operated hydraulically. The apparatus can perform downhole operations from the seabed, obviating the need for a riser.

Preferably, in use, the/each tool is adapted to be winched to a downhole location on the hose.

According to a third aspect of the present invention there is provided a downhole plug, the plug comprising:

a housing;

at least one seal for sealing the plug in a conduit; and at least one anchor for preventing relative movement between the plug and a conduit;

wherein, in use, the plug is adapted to be released from a conduit by the application of a downward force.

In at least one embodiment of the invention, a downhole plug is provided which is released from a conduit, in use, by the application of a downward force.

Preferably, the downward force is applied by hydraulic pressure.

According to a fourth aspect of the present invention there is provided a downhole plug, the plug comprising:

a housing comprising a first section and a second section;

at least one seal for sealing the plug in a conduit; and at least one anchor for preventing relative movement between the plug and a conduit;

wherein, in use, on application of a downward force the first housing section moves relative to the second housing section to release the/each seal from the conduit.

In at least one embodiment of the invention, a plug is provided in which the seal can be released from the conduit by relative movement of sections of the plug housing.

Preferably, on application of a downward force the first housing section moves upward relative to the second housing section.

In one embodiment the seal elements are removed from the seal bore by the upward movement of the upper section of the plug Preferably, on application of the downward force, one of the first or second housing section remains stationary with respect to the conduit.

Preferably, the downward force is applied by hydraulic pressure.

According to a fifth aspect of the present invention there is provided a method of running a subsea production tree and de-suspending a well, the method comprising the steps of:

connecting an apparatus comprising a tree running tool, at least one tool, one of said tools being a plug retrieval tool, and a tool deployment device, to a production tree;

running said apparatus and said production tree to a well-head;

attaching said production tree to said well-head;

testing the integrity of said production tree;

deploying and hydraulically operating a plug retrieval tool using a tool deployment device to retrieve a plug from the tubing hanger to de-suspend the well.

Preferably, the method further comprises the step of storing the retrieved plug in an apparatus storage portion.

According to a sixth aspect of the present invention there is provided an apparatus for performing a downhole operation comprising:

a housing adapted to be connected a subsea production tree;

at least one hydraulically operated tool for performing a downhole operation;

at least one flexible tension member for raising or lowering the at least one tool to or from a downhole location; and at least one winch.

It will be understood that preferred or alternative features of one aspect of the invention may be equally applicable to another aspect of the invention and they are not repeated for brevity.

BRIEF DESCRIPTION OF THE DRAWINGS

Embodiments of the present invention will now be described with reference to the accompanying drawings in which.

DETAILED DESCRIPTION OF THE DRAWINGS

Figure 1:
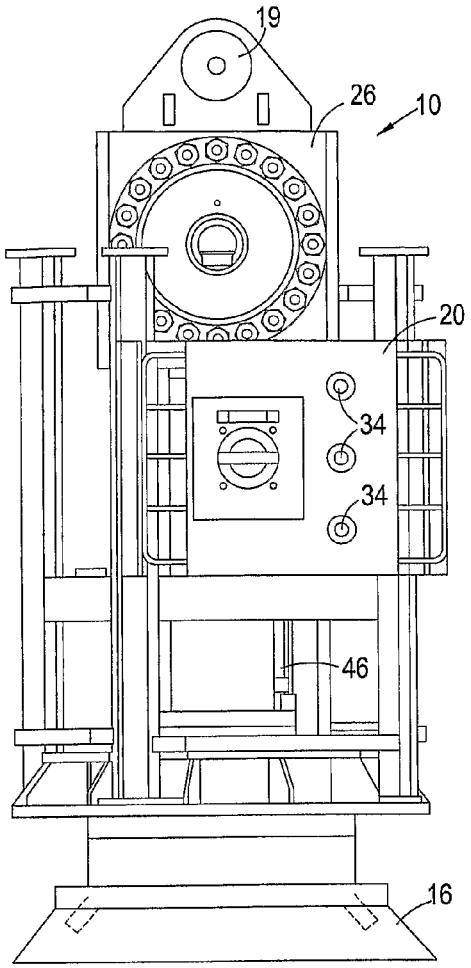
FIG. 1 is a side view of an apparatus for remotely installing a subsea production tree and de-suspending a well according to a first embodiment of the present invention.
Figure 2:
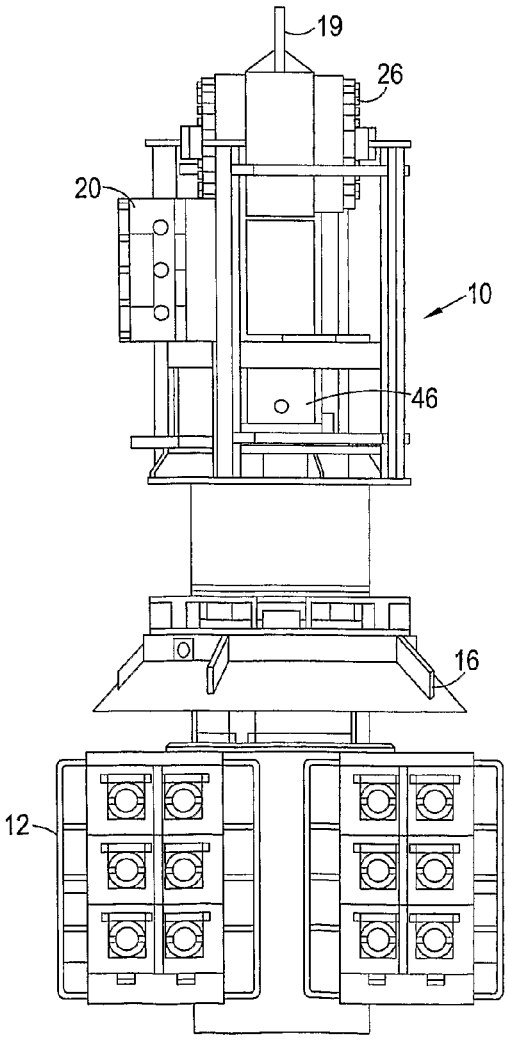
FIG. 2 is a second side view of the apparatus of FIG. 1 shown attached to a production tree.
Figure 3:
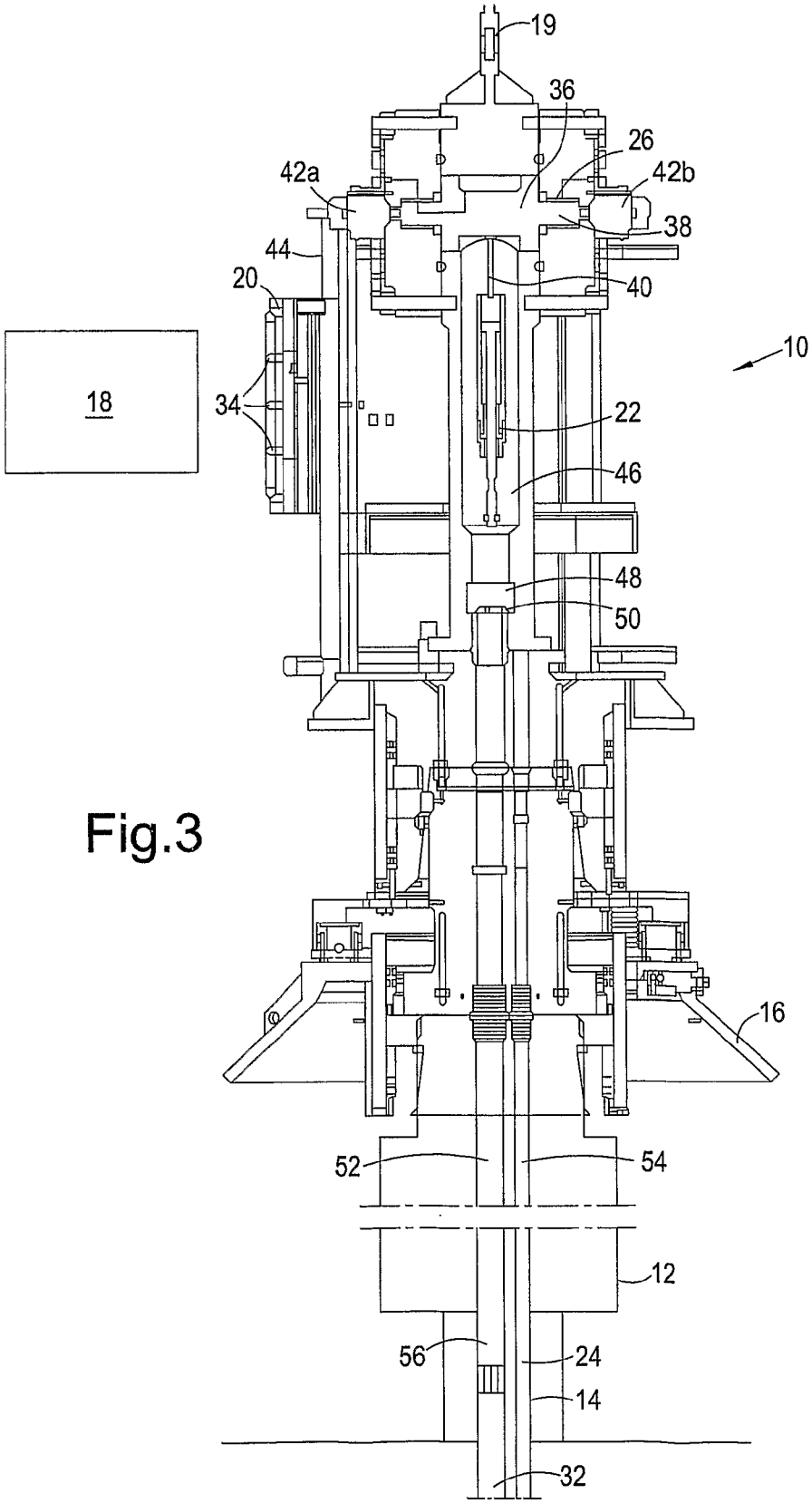
FIG. 3 is a longitudinal sectional view of the apparatus of FIG. 1 shown attached to a production tree and a tubing hanger with the retrieving tool shown in the extension sub and the tool catcher closed.

Referring firstly to FIGS. 1, 2 and 3, an apparatus, generally indicated by reference numeral 10, is shown for running a subsea production tree 12 to a subsea location and de-suspending a well 14, according to a first embodiment of the present invention. The apparatus 10 comprises a tree running tool 16 adapted to be connected to the production tree 12, a plug retrieval tool 22 (FIG. 3) for retrieving a plug 24 (FIG. 3), a tool deployment device 26 and an interface panel 20 adapted to interface with a remotely operated vehicle (ROV) 18 (FIG. 3). The interface panel 20 (best seen in FIG. 1) includes a number of stabs 34 adapted to be engaged by the ROV 18. Once engaged with one of the stabs the ROV 18 can operate the apparatus 10 to perform a number of functions, such as operate the plug retrieval tool 22.

The apparatus 10 further comprises a rope/wire termination sub 19 to which a rope or wire can be connected to lower the apparatus 10 and the production tree 12 from a mono-hull vessel (not shown) to the tubing hanger 14.

According to this embodiment and referring particularly to FIG. 3, the apparatus 10 permits the production tree 12 to be run down to the tubing hanger 14 from a mono-hull vessel such as a ship (not shown). The ROV 18 can then position and attach the tree 12 to the tubing hanger 14, and pressure test the tree 12 to ensure that it is fit for purpose. The ROV 18 then engages and operates the apparatus 10 to remove the isolation plug 24 from the tubing hanger 14 to de-suspend the well 32 as will be described in detail.

Referring to FIG. 3, the tool deployment device 26 comprises a winch assembly 36. The winch assembly 36 includes a winch drum 38, rotation of which raises and lowers the plug retrieval tool 22 on a hydraulic hose 40. The winch drum 38 is rotated by first and second piston motors 42*a*, 42*b* which are powered by hydraulic fluid pumped from the ROV 18 through one of the ROV stabs 34 located on the interface panel 20. A hydraulic line 44 runs between the interface panel 20 and the hydraulic piston motors 42 to transfer the hydraulic fluid from the ROV 18 to the motors 42.

Figure 14:
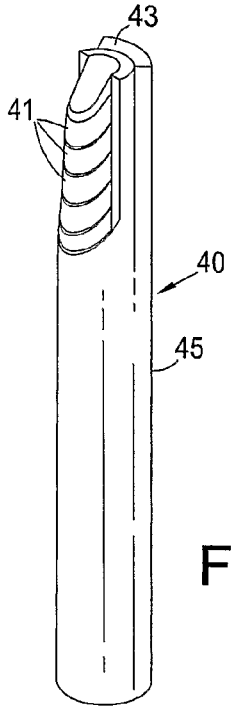
FIG. 14 is a perspective view and partially cut away view of a hydraulic hose.

The hydraulic hose 40 is best shown on FIG. 14. The hose 40 comprises six layers or spirals 41, the internal layer 43 being a nylon tube for chemical resistance and the external layer 45 being a tough abrasion resistant polyurethane cover. The hose 40 transmits hydraulic fluid from the ROV 18 via the interface panel 20, the hydraulic line 44 and the winch assembly 36 to the plug retrieval tool 22. The operation of the plug retrieval tool 22 will be described in due course.

The tool 22 is housed within a storage portion 46. The a storage portion 46 stores both the retrieval tool 22 and the isolation plug 24 once the plug 24 has been retrieved from the tubing hanger 14. A tool catcher 48 is provided at a lower end of the a storage portion 46 to prevent the tool 22 or the isolation plug 24, once recovered, from inadvertently being dropped back into the tubing hanger 14. The tool catcher 48 comprises a flapper 50 which is moveable between opened and closed positions by rotation of a valve actuator (not shown).

Figure 5:
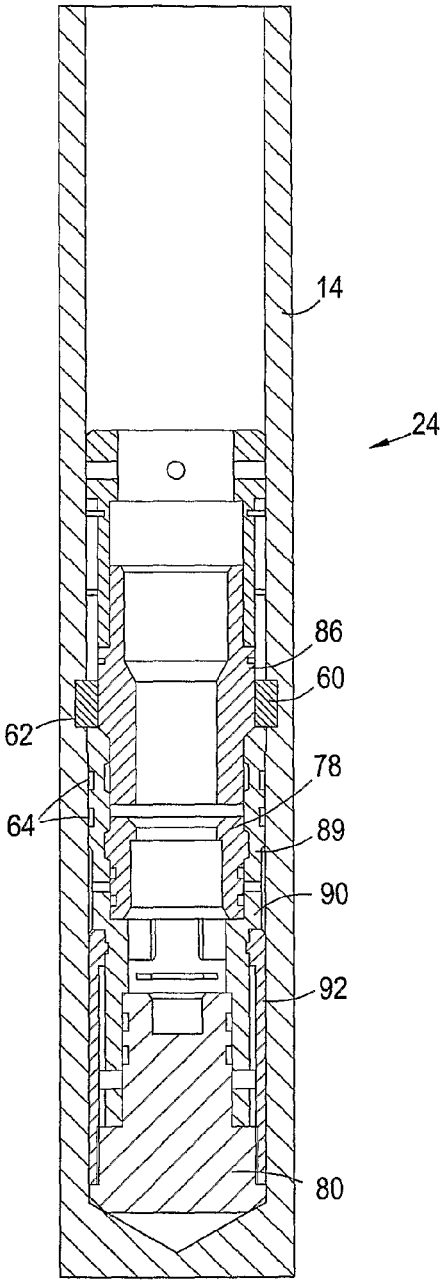
FIG. 5 is an enlarged view of the isolation plug of FIG. 4 shown located in the tubing hanger.
Figure 6:
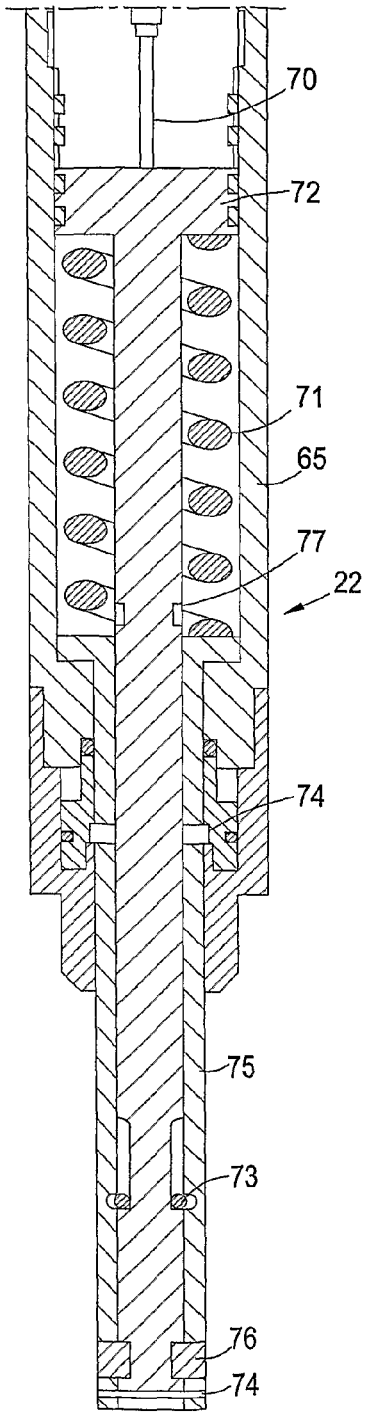
FIG. 6 is an enlarged sectional view through the retrieval tool of the apparatus of FIG. 1.

FIGS. 5 and 6 show enlarged sectional views of the plug 24 and the plug retrieval tool 22 respectively. Referring to FIG. 5, the plug 24 comprises a plug body 89 having upper and lower sections 90,92, a plug base 80, eight locking dogs 60, a dog expander 86 and a plug equalization sleeve 78. The plug 24 is secured to the tubing hanger 14 by the locking dogs 60. The dogs 60 engage a tubing hanger profile 62. The plug 24 further comprises two sets of seals 64 which act as the primary isolation means for sealing the tubing hanger production bore 56.

Referring to FIG. 6, the retrieval tool 22 comprises a body 65, a tool mandrel 72 and a hydraulic fluid inlet 70 through which hydraulic fluid can be pumped to drive the tool mandrel 72 downwards against a release spring 71. The retrieval tool 22 further comprises a retrieval tool shear pin 74 pinning the mandrel 72 to an actuator shaft 75. The mandrel 72 further comprises an equalising sleeve stop 73, the purpose of which will be described in detail later. Towards the lower end of the mandrel 72 are a set of pulling collettes 76 and towards the upper end there is a recess 77 which is adapted to co-operate, during the operation of the tool, with a locking ring 79 to lock the mandrel 72. Again this will be described in detail later.

The operation of the apparatus 10 will now be described. Referring firstly to FIG. 3, the apparatus 10 and the production tree 12 are run from a ship (not shown) to the tubing hanger 14. The ROV 18 engages the production tree 12 and orientates the tree 12 so that it can be landed on the tubing hanger 14. Once the tree 12 is landed on the tubing hanger 14, the ROV 18 secures the connection therebetween.

The tree 12 is tested to ensure the integrity of the production bore 52 and annulus bore 54 by the ROV 18. The production bore test is conducted against the isolation plug 24 which is located and locked in the tubing hanger production bore 56. Once these tests have been satisfactorily conducted, the production tree 12 is tested by the ROV 18 to confirm its operational and functional integrity.

Once the production tree test programme has been satisfactorily completed, the well 32 can be de-suspended by removal of the isolation plug 24.

Figure 4:
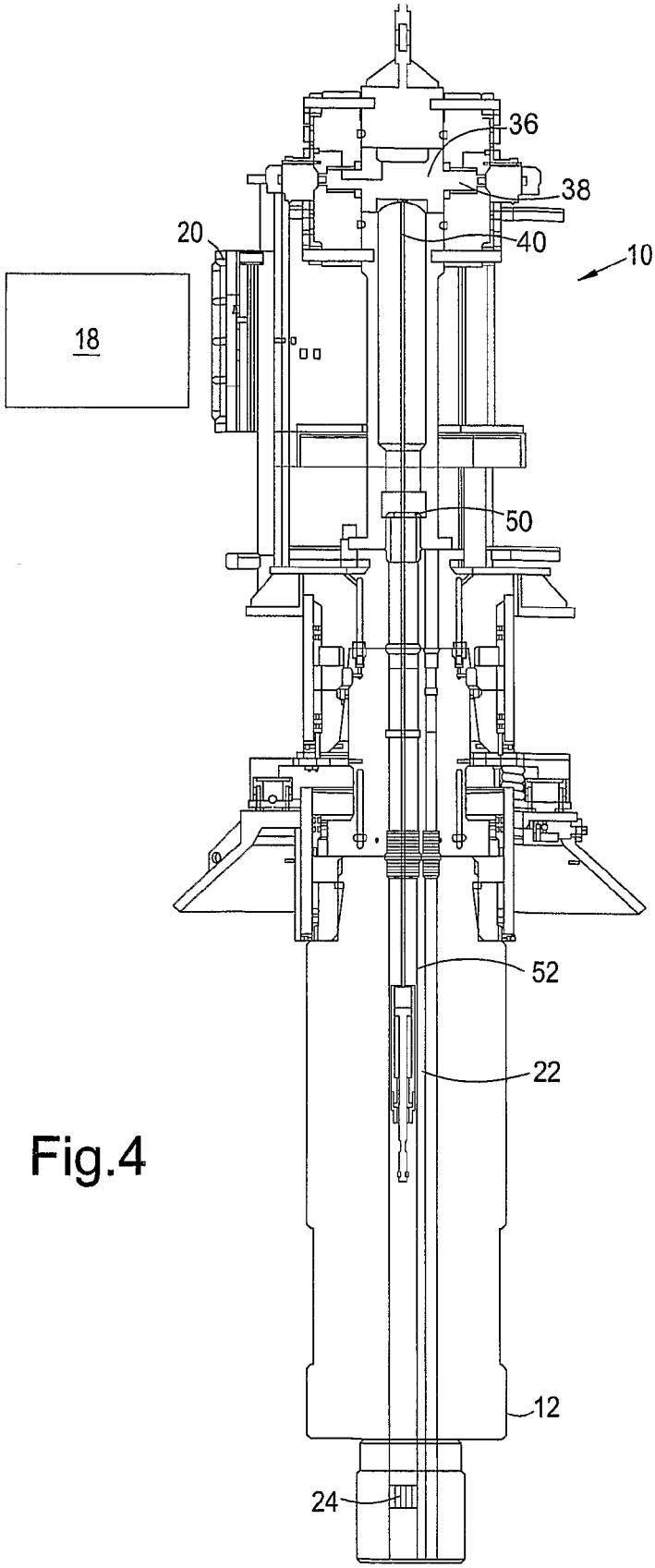
FIG. 4 is a similar view to FIG. 3 showing the retrieval tool being run into the tubing hanger, the tubing hanger being sealed by an isolation plug.

To de-suspend the well 32, the ROV 18 is docked to the apparatus interface panel 20. Referring to FIG. 4, the flapper valve 50 is opened by rotation of the valve actuator (not shown) by the ROV 18 to permit the retrieval tool 22 to be run through the production tree 12 to the isolation plug 24. The tool 22 is lowered through the tree production bore 52 on the hydraulic hose 40 via the winch assembly 36.

Figure 7:
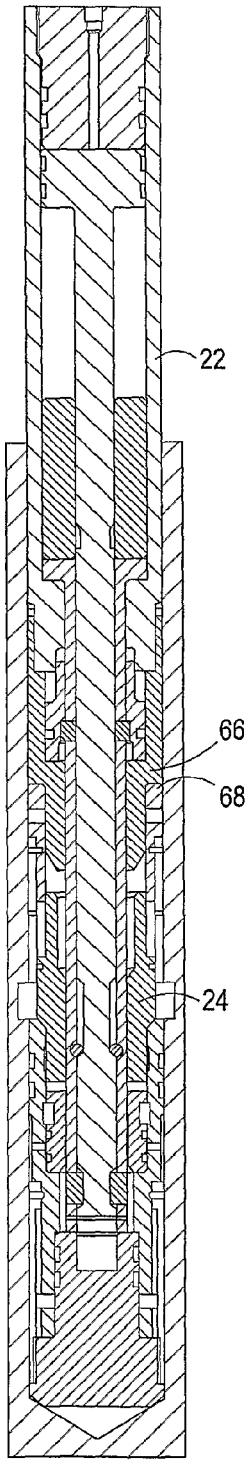
FIGS. 7 to 12 are a series of sequential sectional views similar to FIG. 5 showing the removal of the isolation plug from the tubing hanger by the retrieval tool.

Referring now to FIG. 7, the retrieval tool 22 is lowered into the plug 24 until a retrieval tool shoulder 66 lands on a plug upper surface 68.

Figure 8:
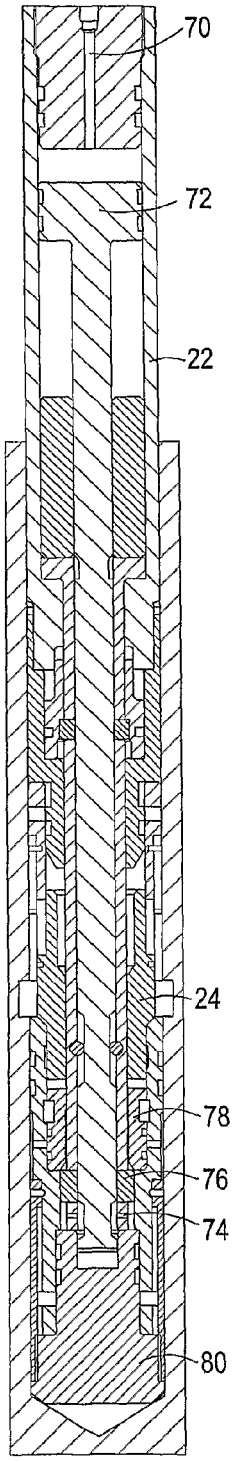

Referring to FIG. 8, hydraulic pressure is then applied through the hydraulic inlet 70 to the mandrel 72. As the mandrel 72 moves down under a hydraulic pressure of about 1000 psi, the retrieval tool shear pin 74 breaks and the mandrel 72 moves in behind the pulling collettes 76, forcing the collettes 76 radially outwards beneath the plug equalization sleeve 78. In this position, the mandrel 72 has engaged the base of the plug 80 and further axial movement in a downward direction is prevented. Further application of hydraulic pressure to the mandrel 72 will result in upward pressure being applied to the components of the plug 24.

Figure 9:
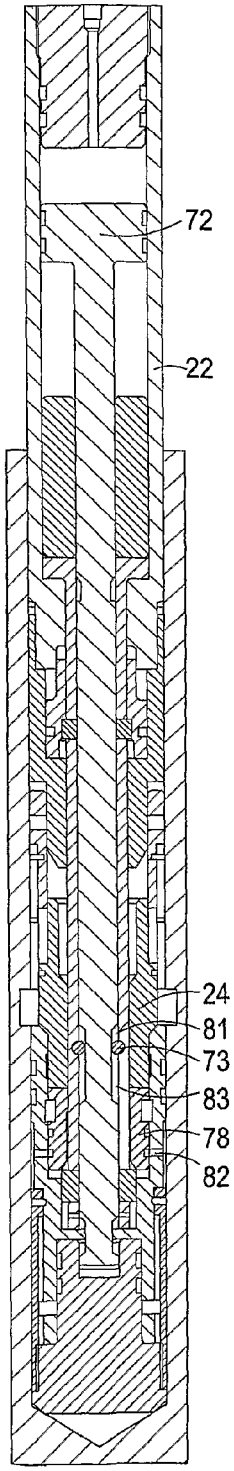

Referring to FIG. 9, the pressure on the tool mandrel 72 is increased to 2,000 psi forcing the equalization sleeve 78 upwards. This opens an equalization flow path 82 permitting the pressure above and below the plug 24 to equalise. Further movement is resisted by the equalising sleeve stop 73 engaging the upper edge 81 of a mandrel recess 83. This resistance provides time for the pressure to equalise before release of the plug 24 from the tubing hanger 14 occurs.

Figure 10:
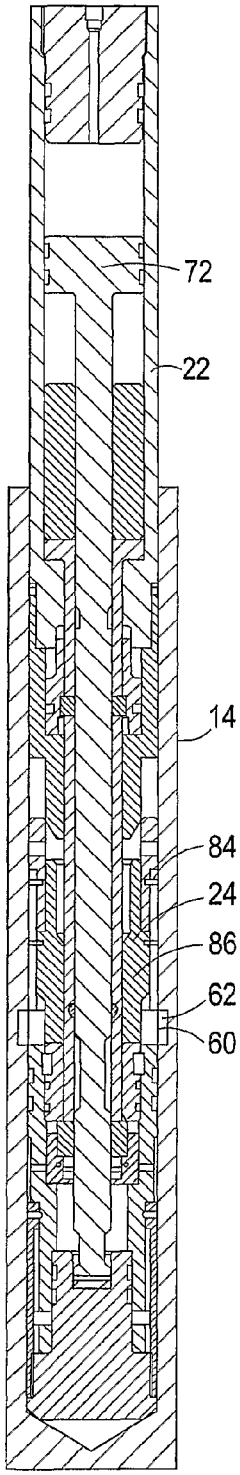

Referring now to FIG. 10, the pressure on the mandrel 72 is increased to 3,000 psi. At this pressure equalising sleeve stop 73 permits the plug dog expander 86 to move upwards due to the action of the pulling collettes 76 and the equalisation sleeve 78 is forced upwards, releasing the plug dogs 60 from the tubing hanger profile 62.

Figure 11:
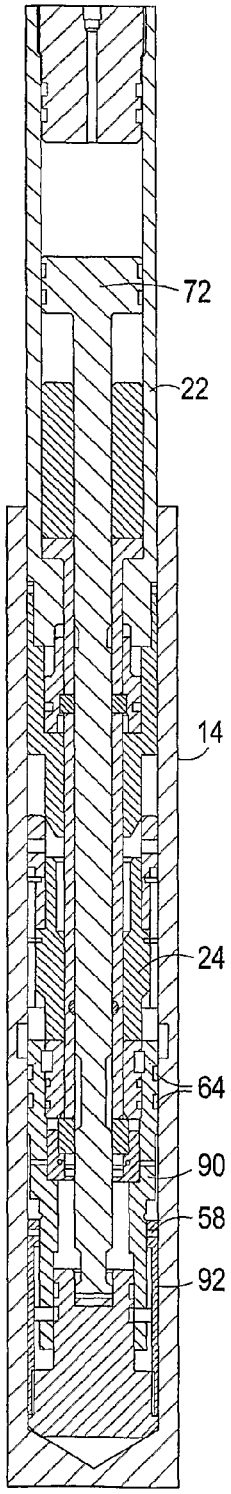

Referring now to FIG. 11, the pressure on the tool mandrel 72 is increased to 4,000 psi and at this pressure the plug body shear pins 88 shear permitting the upper plug body 90 to move with respect to the lower plug body 92, pushing the primary isolation seals 64 upwards, breaking the seal between the tubing hanger 14 and the plug 24.

Figure 12:
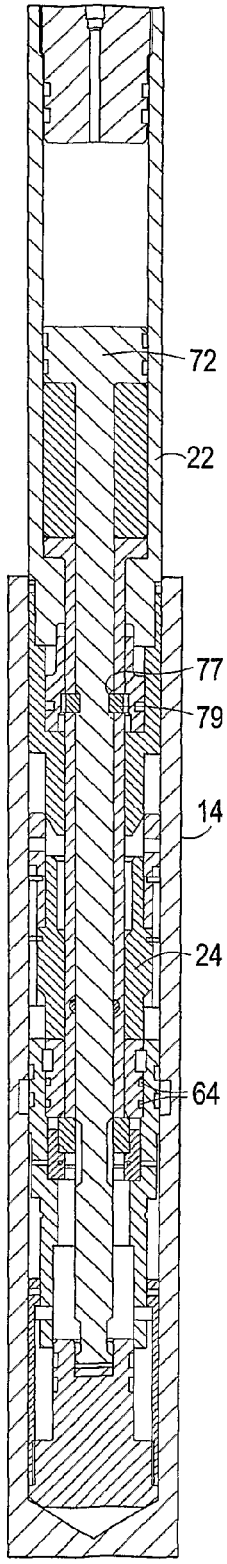

In FIG. 12, the plug seals 64 are fully disengaged from the tubing hanger 14 the locking ring 79 has engaged the mandrel recess 77 locking the mandrel 72 in the direction shown on FIG. 12, and the plug 24 can be recovered to surface.

Figure 13:
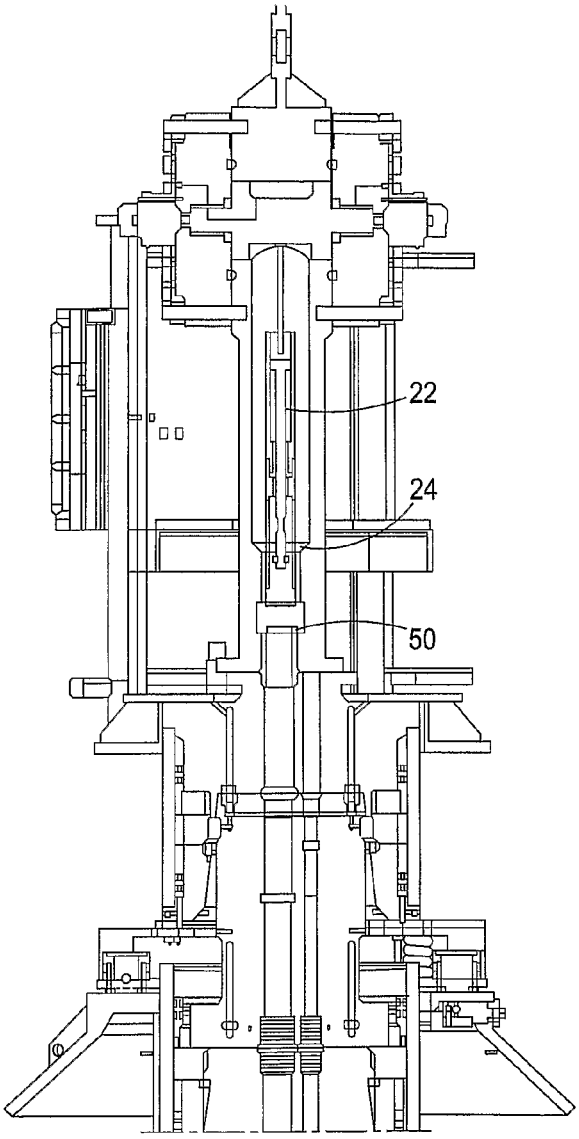
FIG. 13 is a sectional view of the apparatus of FIG. 1 showing the retrieval tool and plug secured in the storage portion.

Referring to FIG. 13, the retrieval tool 22 and the plug 24 have been recovered into the a storage portion 46 and the tool catcher flapper 50 has been closed retaining the tool on the plug 22, 24 inside the a storage portion.

The well 32 has been de-suspended and is ready for production. The apparatus 10 then can be detached from the production tree 12 by the ROV 18 and recovered to surface.

Figure 15:
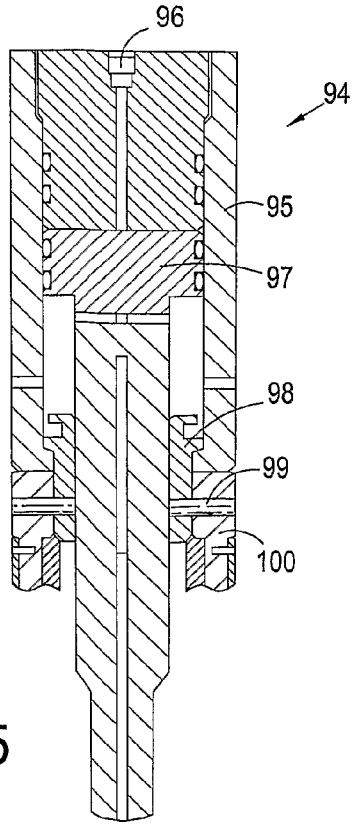
FIG. 15 is a sectional view of a setting tool for the isolation plug of FIG. 5.

In addition to being released hydraulically, the plug 24 can also be set hydraulically. Referring to FIG. 15 a setting tool 94 is shown for setting the plug 24 in the tubing hanger 14. The setting tool 94 comprises a body 95, a hydraulic inlet 96, an actuator piston 97, a piston ring 98 and a lower sub 100, the lower sub 100 being releasably pinned to the piston ring 98 by shear pins 99.

Figure 16:
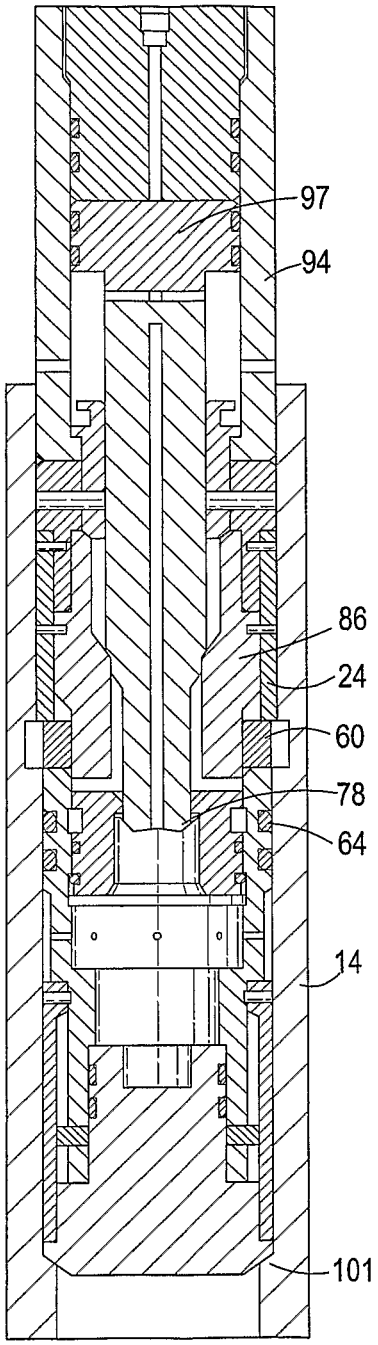
FIGS. 16 to 19 are a series of sequential sectional views showing the setting of the isolation plug in the tubing hanger by the setting tool of FIG. 15.

The steps to set the plug 24 in the tubing hanger 14 will now be described with reference to FIGS. 16 to 19. Referring firstly to FIG. 16, the plug 24 and the setting tool 94 are lowered into the tubing hanger 14 until the plug 24 comes to rest in a tubing hanger nipple profile 101. In this position, the plug isolation seals 64 are engaged with the tubing hanger 14, however, the dogs 60, the dog expander 86 and the equalisation sleeve 78 are in a run-in configuration.

Figure 17:
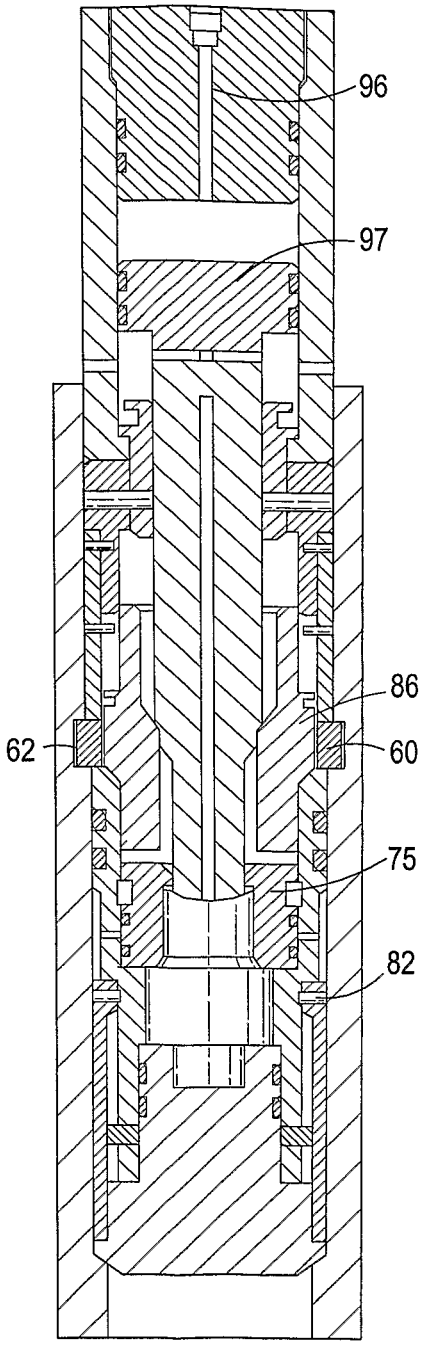

Referring to FIG. 17, hydraulic fluid is pumped through the hydraulic inlet 96 to drive the actuator piston 97 downwards. The actuator piston 97 acts on the dog expander 86 and once a sufficient pressure is reached, approximately 1,500 psi, the expander shear pins 102 break permitting the expander 86 to move downwards, under the action of the piston 97, forcing the dogs 60 into the tubing hanger recess 62. The expander mandrel 86 acts on the equalisation sleeve 78 forcing the sleeve 78 downwards to close the equalisation ports 82. Once the ports 82 are closed, the well 32 is isolated.

Figure 18:
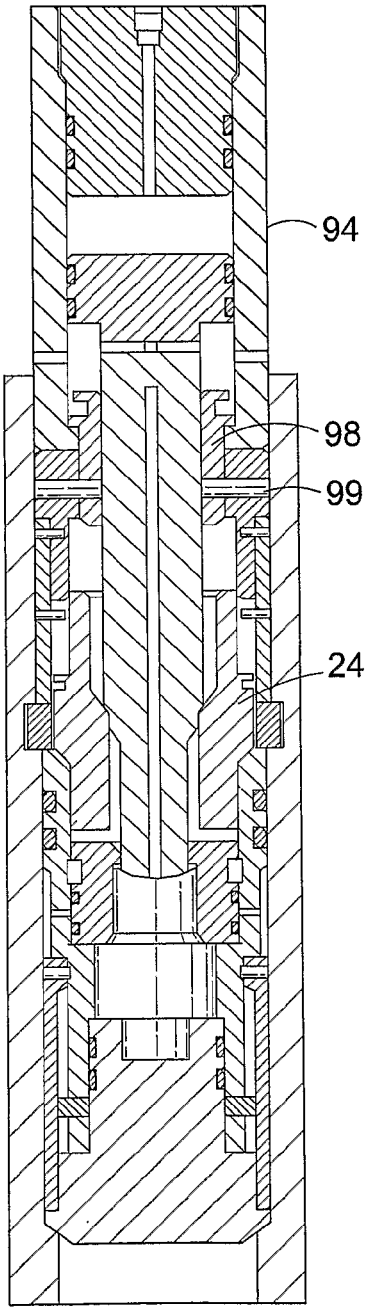

Referring to FIG. 18, continued application of hydraulic pressure results in an upward force being generated against the piston ring 98 and particularly the shear pins 99. Once the pressure reaches about 3,000 psi, the shear pins 99 shear, releasing the tool 94 from the plug 24.

Figure 19:
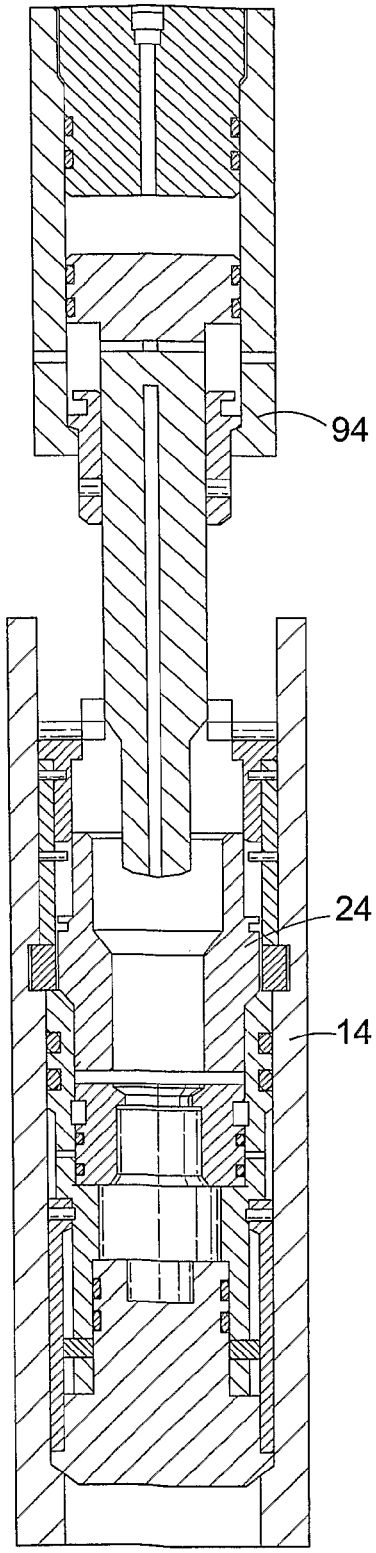

As can be seen from FIG. 19, the tool 94 can then be removed from the plug 24 leaving the plug 24 in the tubing hanger 14, the plug 24 isolating and sealing the well 32.

Figure 20:
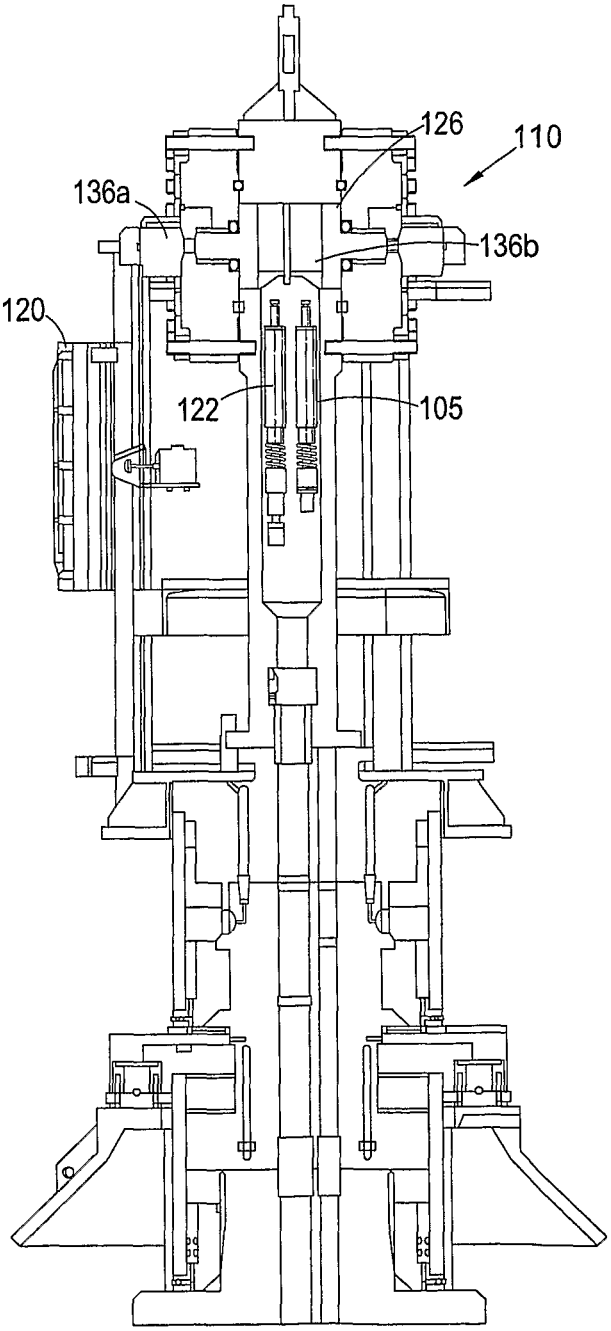
FIG. 20 is a sectional view through an apparatus for remotely installing a subsea production tree and de-suspending a well according to a second embodiment of the present invention.

Reference is now made to FIG. 20, a sectional view through an apparatus, indicated by reference numeral 110, for running a subsea production tree to a subsea location and de-suspending a well, according to a second embodiment of the present invention. The apparatus 110 is largely the same as the apparatus 10 of the first embodiment, the main difference being that the tool deployment device 126 of apparatus 110 comprises two winch assemblies 136*a* and 136*b*. The first winch assembly 136*a* is adapted to raise and lower a plug retrieval tool 122 and the second winch assembly 136*b* is adapted to raise or lower a second tool 105. The second tool 105 could be a backup plug retrieval tool 122 or could serve another function. Each winch assembly 136*a,b* is independently controlled by an ROV (not shown) through the ROV interface panel 120.

It will be understood various modifications and improvements may be made to the above-described embodiment without departing from the scope of the invention. For example, the apparatus may comprise further tools for performing additional downhole operations such as opening or closing valves. In a further alternative, the ROV may test the integrity of the tree through the apparatus interface panel, the apparatus providing hydraulic communication from the interface panel to the tree through the tree running tool.

The invention claimed is:

1. A self-contained apparatus for remotely running a subsea production tree and desuspending a well, the apparatus comprising:

a tree running tool adapted to be connected to a production tree and configured to run the production tree down to a wellhead;

at least one downhole tool, at least one of the tools being a plug retrieval tool; and a tool deployment device in hydraulic communication with at least the plug retrieval tool to hydraulically operate the plug retrieval tool.

2. The apparatus of claim 1, wherein the apparatus is adapted to be lowered from a ship or other mono-hull vessel.

3. The apparatus of claim 1, wherein the apparatus further comprises a control interface.

4. The apparatus of claim 3, wherein the control interface is adapted to interact with at least one control device.

5. The apparatus of claim 4, wherein the control device is a remotely operated vehicle (ROV).

6. The apparatus of claim 4, wherein the control device is operated from surface.

7. The apparatus of claim 1, wherein the tool deployment device is hydraulically operated.

8. The apparatus of claim 4, wherein the control device is electrically, pneumatically or hydraulically/electrically operated or by any suitable means.

9. The apparatus of claim 1, wherein the tool deployment device comprises at least one winch.

10. The apparatus of claim 9, wherein the/each winch is hydraulically operated.

11. The apparatus of claim 9, wherein the winch is electrically, pneumatically or hydraulically/electrically operated or operated by any suitable means.

12. The apparatus of claim 9, wherein the/each winch comprises a winch drum.

13. The apparatus of claim 12, wherein the/each winch drum is driven by at least one hydraulically operated motor.

14. The apparatus of claim 13, wherein the/each winch drum is driven by at least one hydraulically operated piston motor.

15. The apparatus of claim 14, wherein there are first and second winches, each winch being driven by a hydraulically operated piston motor.

16. The apparatus of claim 9, wherein each winch is adapted to raise or lower a hydraulically operated tool into a well bore.

17. The apparatus of claim 16, wherein at least one of the tools is a plug running tool.

18. The apparatus of claim 7, wherein the hydraulically operated deployment device is adapted to be operated by the hydraulic output of an ROV.

19. The apparatus of claim 9, wherein one of said winches is adapted to raise or lower the plug retrieval tool out of or into the well.

20. The apparatus of claim 1, wherein the tool deployment device further comprises at feast one flexible tension member to raise or lower the at least one tool.

21. The apparatus of claim 20, wherein the flexible tension member is a hose.

22. The apparatus of claim 21, wherein the hose is a hydraulic hose.

23. The apparatus of claim 21, wherein the hose comprises multiple layers or spirals.

24. The apparatus of claim 23, wherein the hose is a six spiral wire reinforced hose.

25. The apparatus of claim 22, wherein the hose has a nylon core tube.

26. The apparatus of claim 22, wherein the hose has a polyurethane cover.

27. The apparatus of claim 22, wherein the hose has a collapse pressure of 9,760 psi and a maximum internal pressure of 26,100 psi.

28. The apparatus of claim 21, wherein the hose is a steel line or any suitable pressure conduit.

29. The apparatus of claim 20, wherein the flexible tension member is a wireline cable.

30. The apparatus of claim 1, wherein the apparatus comprises at least one attachment device adapted to allow at least one line or rope to be attached to the apparatus to facilitate raising and lowering of the apparatus from a vessel to the seabed.

31. The apparatus of claim 1, wherein the apparatus further comprises a storage portion.

32. The apparatus of claim 31, wherein the storage portion is a high pressure portion.

33. The apparatus of claim 31, wherein the storage portion is adapted to house the/each tool and, in use, a downhole plug.

34. The apparatus of claim 1, wherein the tree running tool permits, in use, the self-contained apparatus to communicate with the production tree.

35. The apparatus of claim 1, wherein the tree running tool permits the apparatus to communicate hydraulically with the production tree.

36. The apparatus of claim 1, wherein the apparatus comprises a tool catcher.

37. The apparatus of claim 36, wherein the tool catcher is located at or adjacent to a lower end of a conduit.

38. The apparatus of claim 1, wherein the plug-retrieving tool is hydraulically actuated.

39. The apparatus of claim 1, wherein in use, the plug-retrieving tool is adapted to apply an upward force to a plug to release the plug from a conduit.

40. The apparatus of claim 1, wherein the/each tool is hydraulically actuated.

41. The apparatus of claim 1, wherein the apparatus comprises a valve to permit the plug retrieval tool to be run through the tree running tool.

42. A method of running a subsea production tree and desuspending a well, the method comprising the steps of:

connecting a self-contained apparatus comprising a tree running tool, at least one downhole tool, one of said tools being a plug retrieval tool, and a tool deployment device, to a production tree;

running said apparatus and said production tree to a well-head;

attaching said production tree to said well-head;

testing the integrity of said production tree;

deploying and hydraulically operating the plug retrieval tool using the tool deployment device to retrieve a plug from a tubing hanger to de-suspend the well.

43. The method of claim 42 further comprising the method further comprises the step of storing the retrieved plug in an apparatus storage portion.

* * * * *